US005596313A

United States Patent [19]

Berglund et al.

[11] Patent Number: 5,596,313

[45] Date of Patent: Jan. 21, 1997

[54] DUAL POWER SECURITY LOCATION SYSTEM

[75] Inventors: Victor P. Berglund, McKinney; Richard R. Jaffe, Dallas, both of Tex.

[73] Assignee: Personal Security & Safety Systems, Inc., Dallas, Tex.

[21] Appl. No.: 442,469

[22] Filed: May 16, 1995

[51] Int. Cl.[6] ..... G08B 25/12

[52] U.S. Cl. ..... 340/574; 340/539; 340/573; 342/126; 342/146

[58] Field of Search ..... 340/574, 573, 340/539; 342/126, 146

[56] References Cited

U.S. PATENT DOCUMENTS

| | | | |
|---|---|---|---|
| 4,234,874 | 11/1980 | Saya | 340/539 |
| 4,275,385 | 6/1981 | White | 340/825.49 |
| 4,369,426 | 1/1983 | Merkel | 340/904 |
| 4,446,454 | 5/1984 | Pyle | 340/538 |
| 4,511,887 | 4/1985 | Fiore | 340/539 |
| 4,523,184 | 6/1985 | Abel | 340/539 |
| 4,559,526 | 12/1985 | Tani et al. | 340/539 |
| 4,593,273 | 6/1986 | Narcisse | 340/539 |
| 4,598,275 | 7/1986 | Ross et al. | 340/573 |
| 4,606,073 | 8/1986 | Moore | 455/89 |
| 4,647,914 | 3/1987 | Alexander | 379/44 |
| 4,651,157 | 3/1987 | Gray et al. | 342/457 |
| 4,661,804 | 4/1987 | Abel | 340/539 |
| 4,670,739 | 6/1987 | Kelly, Jr. | 340/539 |
| 4,682,155 | 7/1987 | Shirley | 340/573 |
| 4,694,282 | 9/1987 | Tamura et al. | 340/539 |
| 4,737,771 | 4/1988 | Coash | 340/539 |
| 4,764,757 | 8/1988 | DeMarco et al. | 340/574 |
| 4,792,804 | 12/1988 | Rubechini | 342/27 |
| 4,853,692 | 8/1989 | Wolk et al. | 340/573 |
| 4,864,277 | 9/1989 | Goodman | 340/539 |
| 4,884,067 | 11/1989 | Nordholm et al. | 340/686 |
| 4,908,627 | 3/1990 | Santos | 342/125 |
| 4,910,493 | 3/1990 | Chambers et al. | 340/426 |
| 4,918,425 | 4/1990 | Greenberg et al. | 340/539 |
| 4,952,928 | 8/1990 | Carroll et al. | 340/825.54 |
| 4,978,946 | 12/1990 | Nordholm et al. | 340/573 |
| 4,998,095 | 3/1991 | Shields | 340/574 |
| 5,021,794 | 6/1991 | Lawrence | 342/457 |
| 5,025,247 | 6/1991 | Banks | 340/574 |
| 5,045,839 | 9/1991 | Ellis et al. | 340/539 |
| 5,070,320 | 12/1991 | Ramono | 340/539 |
| 5,115,223 | 5/1992 | Moody | 340/573 |
| 5,196,825 | 3/1993 | Young | 340/539 |
| 5,200,735 | 4/1993 | Hines | 340/539 |
| 5,204,670 | 4/1993 | Stinton | 340/825.54 |
| 5,218,344 | 6/1993 | Ricketts | 340/573 |
| 5,223,816 | 6/1993 | Levinson et al. | 340/539 |
| 5,225,809 | 7/1993 | Bunn | 340/574 |
| 5,235,320 | 8/1993 | Romano | 340/539 |
| 5,257,007 | 10/1993 | Steil et al. | 340/539 |
| 5,278,539 | 1/1994 | Lauterbach et al. | 340/539 |
| 5,283,549 | 2/1994 | Mehaffey et al. | 340/521 |
| 5,289,163 | 2/1994 | Perez et al. | 340/539 |
| 5,311,185 | 5/1994 | Hochstein et al. | 342/44 |

*Primary Examiner*—Glen Swann
*Attorney, Agent, or Firm*—Gregory M. Howison

[57] ABSTRACT

A security system is provided wherein a portable locator (10) is disposed on a protected person and, with the use of an alarm switch (88), an individual can set the locator (10) to continuously transmit an alarm signal. This alarm signal is comprised of a pseudonoise (PN) code ORed with data and transmitted over a carrier frequency. This carrier frequency is then transmitted to a plurality of fixed receivers (14). The fixed receivers (14) note the time of arrival and then determine via this time of arrival the approximate location of the locator (10). During this time, the locator (10) operates in a high power mode that is sufficient to reach each of the receivers (14). This occurs for a short time and then the locator (10) goes into a low power mode to conserve the battery. During this low power mode, a portable monitor (62) is provided that has two receivers (66) and (68). Two antennas (70) and (72) are associated therewith. The system operates on an angle of arrival method. This basically gives left-right direction to the portable monitor (62). The portable monitor (62) is moved into the general location of the locator (10) to further refine and determine the exact location of the locator (10).

13 Claims, 10 Drawing Sheets

DUAL POWER SECURITY LOCATION SYSTEM

BACKGROUND OF THE INVENTION

Location of objects has been solved in a number of ways for a number of purposes. One type that has been widely used is that referred to as the Vehicle Location System (VLS). This type of system utilizes a number of antennas, approximately three, that are disposed about a given location such as the city. Each vehicle is given a transceiver which is allowed to receive a location request signal, coded for a unique ID associated with the vehicle and then transmit a coded signal at a different frequency. The method of operation is to transmit the signal in a broadcast manner to all of the transceivers on all of the vehicles, the one recognizing its ID, then turning on and transmitting out in a broadcast manner a response having associated therewith the unique ID for that vehicle. A receiver associated with each of the antennas disposed about the location such as the city, then compares the time that the received signal was received at that location and compares it to a common time base. This is then transmitted back to a central station which utilizes a Time of Arrival location technique. This is basically a triangulation method. The problem with this type of system is throughput and the accuracy with which the time base must be maintained. Additionally, these systems must operate over very large areas and, therefore, must have relatively powerful transmitters.

In another type of system, the signpost system, vehicles are located by passing certain "signposts" that are disposed in a grid such as a network of rows in a city. By determining the various field strengths as the vehicle moves through the power field associated with a given signpost transmitter, and also receiving a unique ID from each of the signposts, the vehicle can determine certain information regarding the signpost and transmit it back to a central location that can determine the general location of the vehicle by determining which signpost it is close to. The main problem with prior art systems is that they have difficulty in making precise locations and also require virtually dedicated transmission links in order to maintain the transmission in order to provide the location. For example, in the Vehicle Location System, if the vehicle is moving, it is difficult to ever locate it as throughput allows the transceiver to only respond once to define the location. However, the request for location signal may have been sent out twenty minutes prior to sending out its location. If the vehicle is moving, then it may take another twenty minutes to find the next location of the vehicle.

SUMMARY OF THE INVENTION

The present invention disclosed and claimed herein comprises a personal security system for locating a person within a predetermined locale. The personal security system includes a plurality of receivers that are disposed about the predetermined locale for receiving an alarm transmission, a portable transmitter for being carded on the person is operable to generate over an RF link the alarm transmission. The portable transmitter has an alarm switch for being activated by the person and a battery for supplying power to the portable transceiver. A processor is operable to generate an alarm signal in response to depression of the alarm switch. This alarm signal is then encoded into a carrier as an encoded alarm signal. A transmitter is provided for transmitting the encoded alarm signal as the alarm transmission at either a first power level or a second power level for receipt by receivers. In the first power level, the receivers most closely disposed to the location of the portable transmitter will receive the alarm transmission. At the second power level, the signal is only of sufficient strength to be received by any receiver in the close proximity to the portable transmitter. A central monitoring system is provided for receiving decoded alarm transmissions from each of the receivers with each of the receivers operable to determine the time of receipt of the signals. These times are compared to determine the location based upon time of arrival algorithm. A portable monitoring system is then utilized that has a directional receiver for receiving the alarm transmission. This portable monitoring system is moved within the approximate location determined by the monitoring system and then the exact location of the portable transmitter determined.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
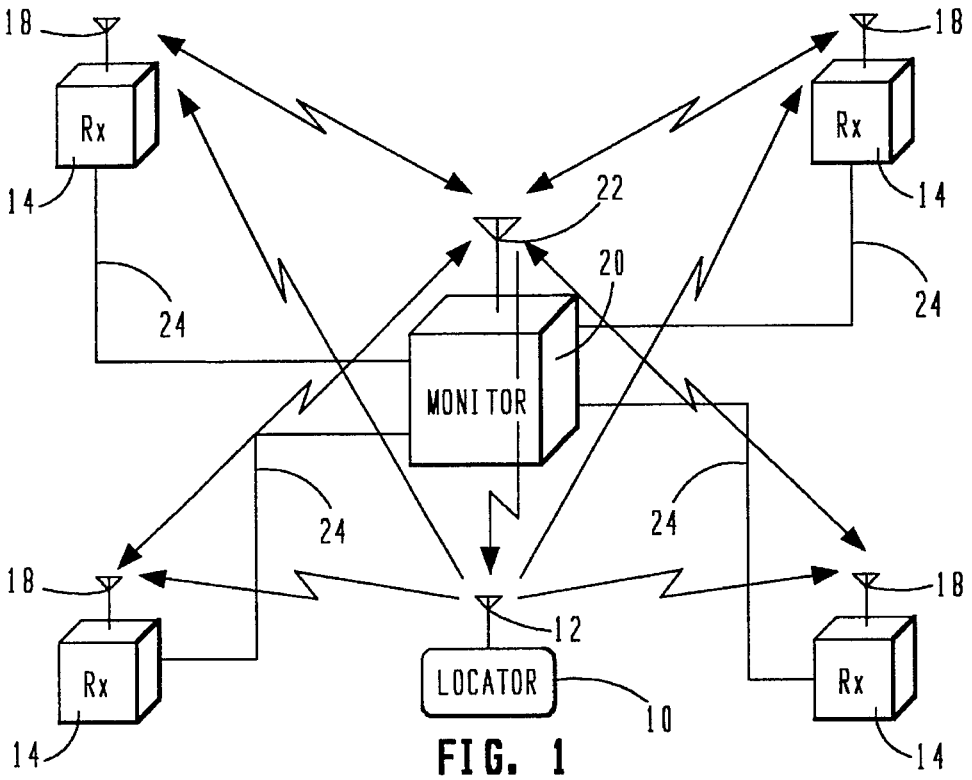
FIG. 1 illustrates an overall system block diagram.

Referring now to FIG. 1, there is illustrated a block diagram of an overall system utilizing the methods of the present invention. A locator unit 10 is provided which is a portable card like device that is disposed on an individual or is carried with an individual. The design of this card can be that utilizing a smart IC card or it can be similar to that utilized with respect to portable pager devices. The locator 10 (not necessarily stationary) has an antenna 12 associated therewith. A plurality of receivers 14 are disposed at various locations about the locator 10, it being noted that the locator 10 and the receivers 14 are stationary in the preferred and disclosed embodiment. Each of the receivers 14 has an antenna 18, which is operable to receive transmissions from the locator 10. Additionally, the antenna 18 can be utilized to communicate with a central monitor 20 that has an antenna 22, the antenna 22 operable to transmit information to the locator 10 and also receive and transmit information between the receivers 14 and the monitor 20 for transmitting information therebetween. Additionally, a land line 24 can be provided for allowing the communication to take place between the receivers 14 and monitor 20, this being for the purpose of relaying information received from the locator 10. However, the land line 24 could be a wireless link.

Figure 2:
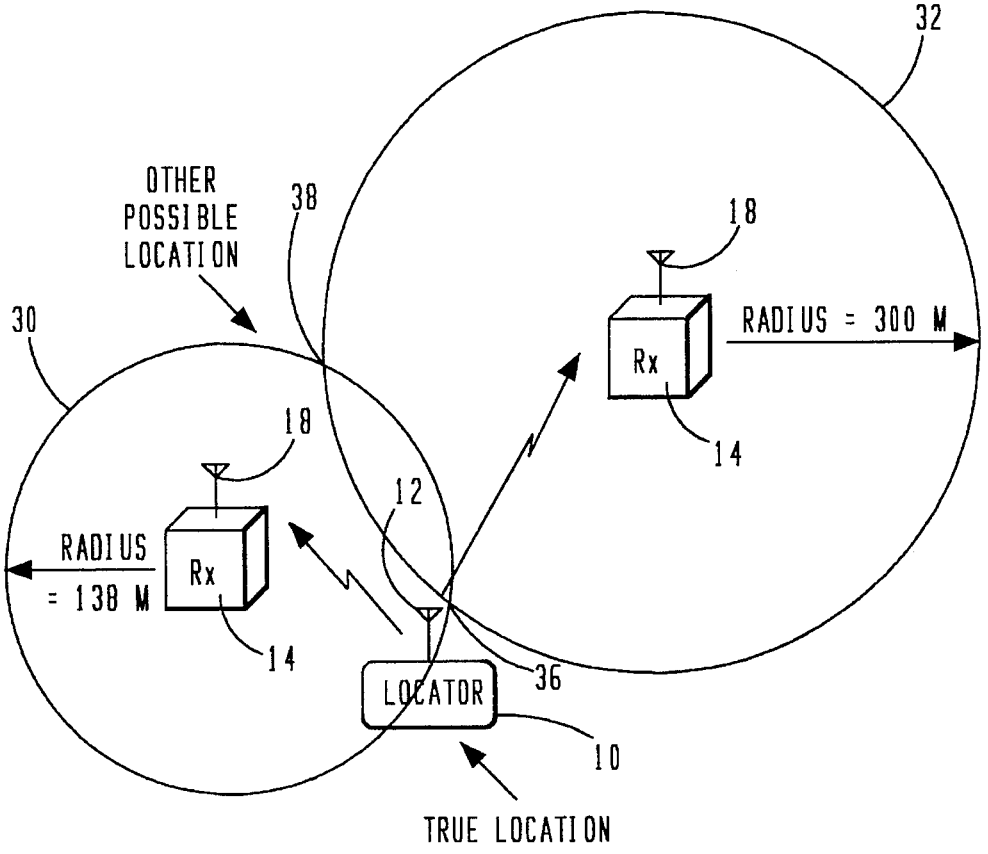
FIG. 2 illustrates a location method utilizing two circles of probability.

Referring now to FIG. 2, there is illustrated a diagrammatic view of a system utilizing only two receivers 14, this for a time of arrival system. In this system, the locator 10 is disposed at a specific location relative to the two receivers, with it being located a farther distance from one receiver compared to the other. The closest receiver receives the signal and can determine a relative time of arrival which will indicate that the receiver is along a loci of points to finding a first circle of probability 30. However, it is also along a second circle of probability 32 relative to a second receiver that is a farther distance away. As such, the receiver associated with the circle 30 will receive a signal first and the receiver 14 associated with the second circle 32 will receive the signal at a later time. However, it can be noted that there is a first actual true location 36 and another possible location 38, this being the point at which the circles 30 and 32 intersect. Therefore, there will be an ambiguity with only using two receivers.

Figure 3:
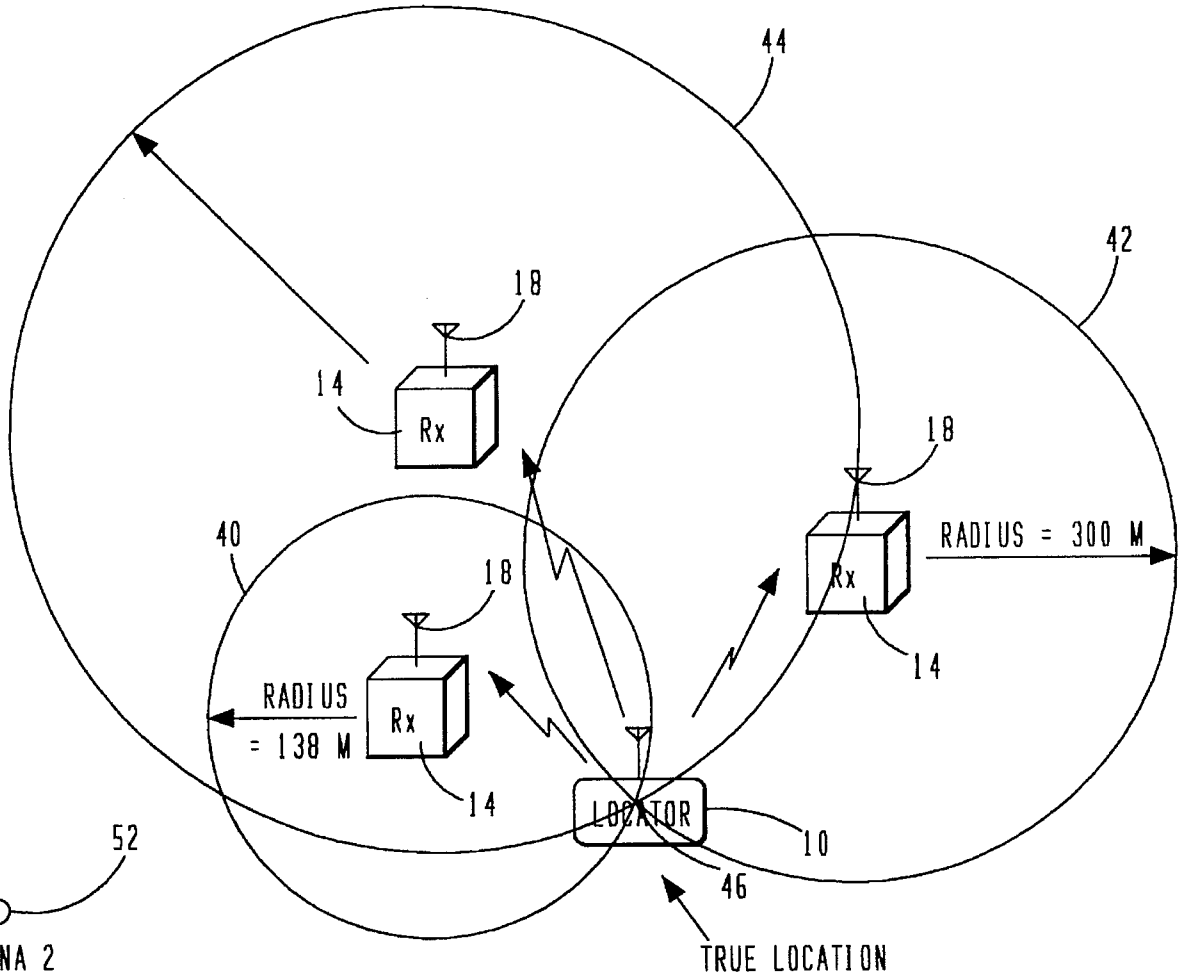
FIG. 3 illustrates a location method utilizing three circles of probability.

Referring now to FIG. 3, there is illustrated a diagrammatic view wherein three receivers 14 are utilized. The closest receiver has a first circle of probability 40 associated therewith, the second receiver has a circle of probability 42 associated therewith and a third receiver 14 has a circle of probability 44 associated therewith, these circles of probability 40–44 are in ascending size, with circle 40 being the smallest. Therefore, the receiver associated with receiver 40 will receive the signal first, the receiver associated with the circle 42 will receive the signal second and the receiver 14 associated with the third circle 44 will receive the signal last. As such, there is only a single location 46 at which the locator 10 can be found. Therefore, a minimum of three receivers are preferable, with more receivers providing a higher degree of resolution.

It should be understood that receivers 14 and the locator 10 communicate via an RF link. RF links in ideal situations, i.e., with no buildings, obstacles, etc. are very accurate transmission links. However, when obstacles are disposed between the transmitter and receiver, problems can exist in the reception due to things such as multi-path. This can, therefore, result in a false reading as the signal taking a longer path and bouncing off of an object can be interpreted as being the main signal. It is important that the time that the signal leaves the transmitter and the time that it arrives at the receiver is a direct line of sight path. The techniques utilized in the present invention provide for an elimination of the multi-path signal, although this is utilized in conventional techniques. It should also be understood that the time of arrival from all locations along any given perfect circle about a receiver may not be the same due to different environmental parameters, etc. This could cause some errors in the location as the time or arrival system typically assumes that the transmission path through any media to the receiver is identical. For example, if a low lying cloud were disposed between one of the receivers and the locator, the transmission delay to that receiver would be different than the transmission delay to another one of the receivers, this not being accounted for in the receiver operation.

Figure 4:
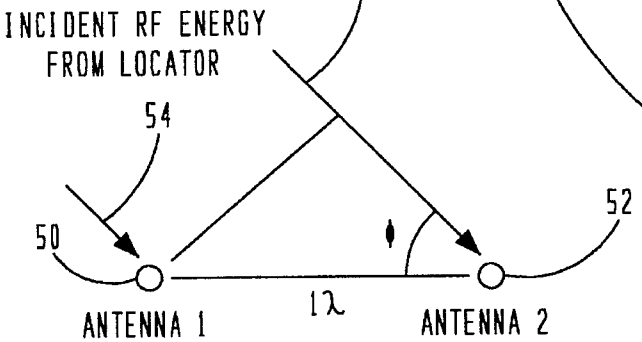
FIG. 4 illustrates a diagrammatic view of an angle of arrival system.

Referring now to FIG. 4, there is illustrated a diagrammatic view of a system using an angle of arrival method. In the angle of arrival method, two antennas 50 and 52 are illustrated. Energy arrives from a locator 10 at the antenna 50 along a path 54 and energy arrives at the antenna 52 along a path 56 from the same locator 10 when they are disposed at an angle $\phi$ relative to the vertical. The antennas are disposed apart a distance of one wavelength ($\lambda$). It can be seen that the energy along path 56 arrives at antenna 52 after the energy along path 54 arrives at the antenna 50. This results in a predetermined amount of delay. This delay can be measured and the angle therefor calculated. This gives a reference. However, it should be noted that this system has difficulty in determining whether the signal arrives in the front or the rear. This, of course, can be accounted for. However, in general, the system of the present invention utilizes a time of arrival method of detection.

Figure 5:
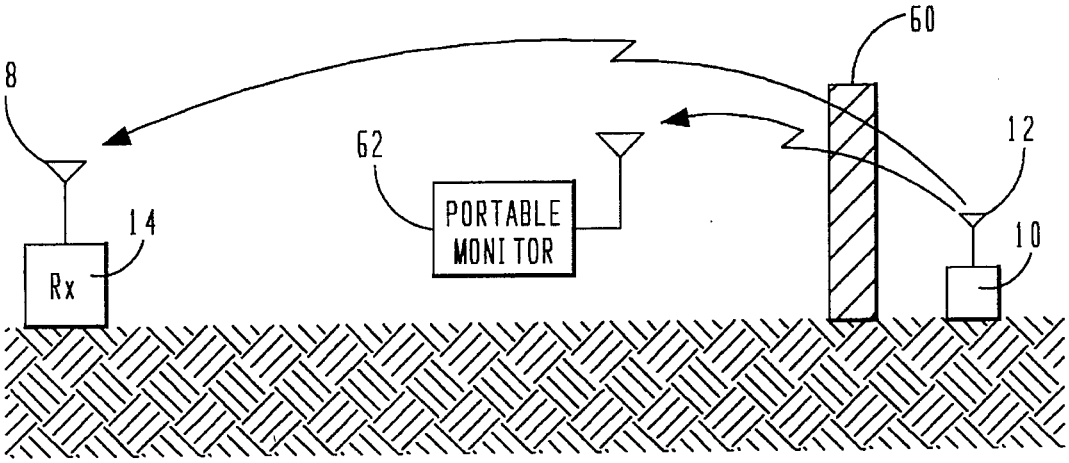
FIG. 5 illustrates a diagrammatic view of an application of the system of the present invention for locating the one of the locators 10.

Referring now to FIG. 5, there is illustrated one application of the system of the present invention. One of the locators 10 is disposed behind a wall 60. The locator 10 operates in two separate modes, a high-power mode and a low power mode. In the high-power mode, sufficient power is extracted from the battery (not shown) associated with the locator unit 10 to allow sufficient signal strength to be transmitted to antenna 18 on the receiver 14 illustrated in FIG. 5, it being known that other receivers are also provided that are not shown. However, due to finite battery limitations, this information can only be transmitted for a short time. Since the system of the present invention does not synchronize the various locator units, if various locator units are transmitting at the high power level at the same time, each of the receivers will receive signals at different times. This is a category in the coding scheme such that identification signals (IDs) associated with each of the locator units 10 can be transmitted along with the alarm signal from the locator unit 10 to the receiver. The receiver 14 can therefore discriminate between the various signals. Further, the signals are transmitted periodically.

Once the main alarm signal and high power level has been transmitted, the locator unit 10 goes into a low power mode and continues transmitting the alarm signals on a periodic basis. Therefore, security personnel can determine that an alarm has been set off and then go to the location determined by the monitor 20. Thereafter, a portable monitor 62 or focus unit is utilized by the security personnel to further define the location of the locating unit 10, which is typically carried by an individual. If, for example, the locator unit 10 were disposed behind a wall 60, as illustrated in FIG. 5, that was not visible by the security personnel, the approximate location within two to three feet would not be helpful. This can be the case where an individual is disposed, for example, in an elevator. With the portable monitor 62, the low power level signal can be detected proximate to the locator unit 10 that is transmitting the alarm signal. This allows the high power system to have more inaccuracies in it while allowing the portable monitor 62 to provide the overall integrity required by a location system. By utilizing the low power mode, the transmission can occur for a much longer time without draining the battery.

Figure 5A:
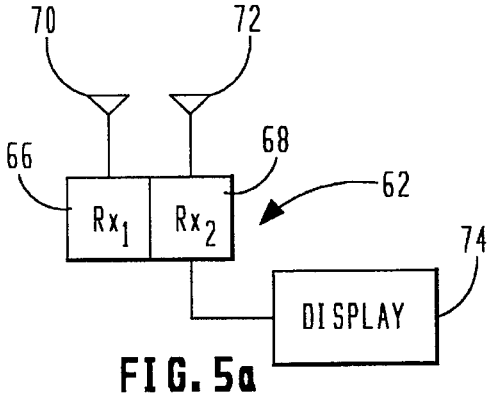
FIG. 5*a* illustrates a block diagram of the portable monitor or focus unit.

Referring now to FIG. 5*a*, there is illustrated a block diagram of the portable monitor 62. The portable monitor 62 utilizes an angle of arrival system for locating an individual. This basically utilizes two identical receivers 66 and 68 and two antennas 70 and 72, respectively, which are disposed at a distance of one wavelength by the operating frequency of the locator unit 10. This allows the security personnel carrying the portable monitor 62 to further refine the location operation. The security personnel need only hold the unit such that the antennas 70 and 72 are parallel to the ground and then view a display 74 that will allow the security personnel to determine if the locator unit 10 is to the left or the right. Typically, there is a power level meter that determines how far away the individual is. The power level meter will indicate to the security personnel that they are walking in the wrong direction, i.e., that the locator unit 10 is behind them. This is typically not a problem as they are trying to determine if the locator unit is behind the wall.

Figure 6:
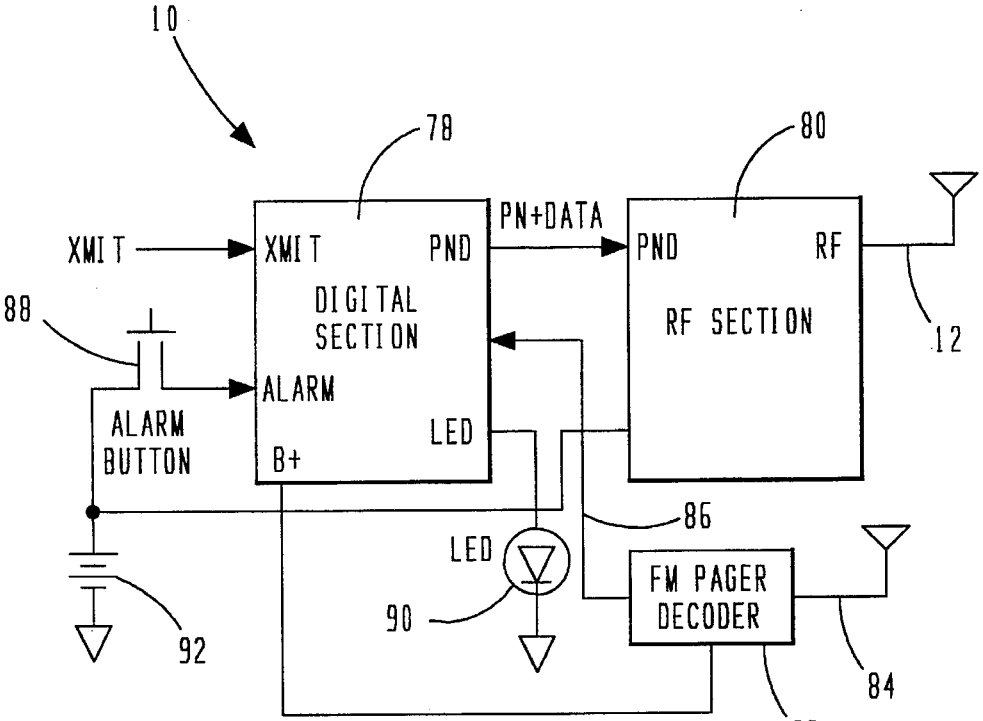
FIG. 6 illustrates a block diagram of a locator.

Referring now to FIG. 6, there is illustrated a block diagram of the locator 10. The locator is comprised of a digital section 78 and an RF section 80 connected to the digital section for receiving data to be transmitted out as an alarm signal. This is transmitted out an RF port on the RF section to the antenna 12. Additionally, an FM pager decoder 82 is provided to provide a receive function at the locator 10. This is interfaced with an antenna 84, although the antenna 84 could be the same as the antenna 12. However, for the purposes of discussion, this is a separate antenna and, in fact, it may utilize a separate antenna. The FM pager decoder section 82 is a conventional pager receiver that receives signals formatted in a Post Office Code Standardization Advisory Group (POCSAG) format which is conventional for pagers. The FM pager decoder 82 is operable to receive conventional paging signals, decode the message and output it as data on a line 86 to the digital section 78. The pager decoder section 82 is operable to allow information to be transmitted from the monitor 20 via antenna 22 to the locator 10. The pager decoder section 82 allows the central station to transmit requests thereto or to download data thereto, as each pager decoder section 82 has associated therewith a unique ID. However, the primary discussion of the locator 10 will be with respect to the transmitted alarm signal.

A transmit signal XMIT for test purposes is received on the input to the digital section 78 which is an input that forces the digital section 78 to transmit in a test mode. Additionally, an alarm button switch 88 is provided, which is connected to an alarm input on the digital section 78. This is a switch that, in the preferred embodiment, is a switch that, when depressed, causes the switch to be maintained in a closed position. Once the "seal" is broken, the switch is "latched". An LED 90 is provided for purposes of displaying the operation, i.e., that the switch 88 has been depressed and that the system is operating. A battery 92 is provided which is connected to the input of the alarm button 88 and also for powering the digital section, RF section and the FM pager decoder 82. The digital section is operable to output the combination of data and code to a coded data input on the RF section 80.

Figure 7:
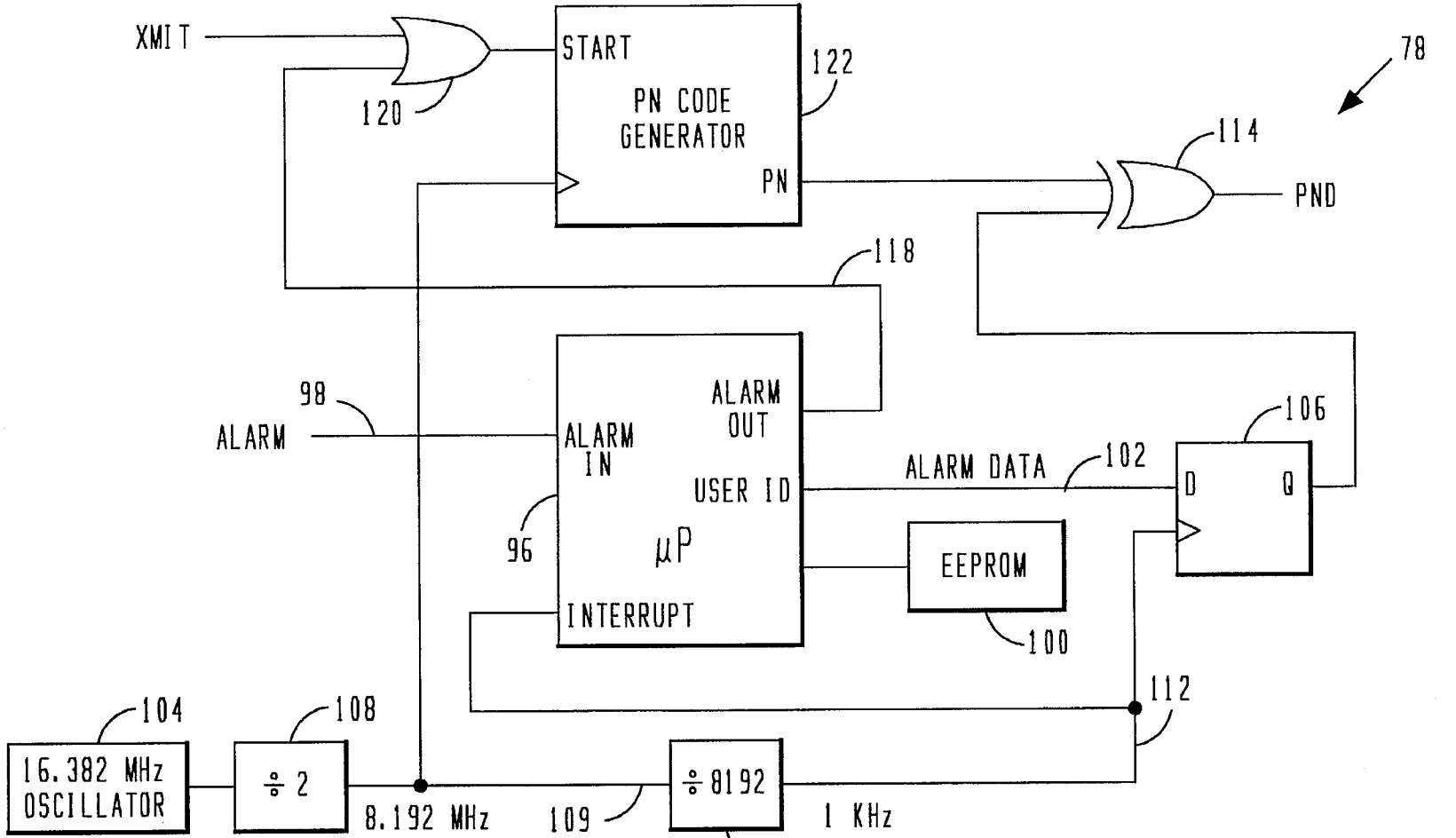
FIG. 7 illustrates a block diagram of the digital section of the locator.

Referring now to FIG. 7, there is illustrated a block diagram of the digital section 78. At the heart of the digital section 78 is a microprocessor 96. The microprocessor is a single-chip microprocessor (8748 or 8751 class), which serves as the overall controller for the locator 10. This device primarily is operable to detect alarm events by reading the status of an alarm bit on an alarm input line 98 that, when at a logic "high" initiates a sequence of events leading up to the transmission of a pseudonoise (PN) code burst. The microprocessor 96 is also operable to indicate status by way of lighting the light emitting diode in various distinctive pattern, depending on what type of information is programmed into the system. For example, a battery low condition could be indicated by a slow flashing, a transmission of alarm signal indicated by a steady display of the LED and a fast periodic flashing could indicate that the device is in working condition. The microprocessor 96 is also operable to generate the alarm data. The data is stored in an Electrically Erasable Programmable Read Only Memory (EEPROM) 100 and is output on a line 102 to a P-type flip-flop 106 on the D-input thereof. A clock signal is generated via a main 16.384 MHz oscillator 104 which is divided by a factor of two in divider 108 to provide a frequency of 8.192 MHz on a line 109. This is input to a divide block 110 to divide the value on line 109 by a factor of 8192 to provide on an output line 112 a 1 kHz signal. This is input to the clock input of the D-type flip-flop 106 to clock the data on the D-input thereof at that rate to provide on the key output thereof the clock data signal to one input of an exclusive OR gate 114. Additionally, the CPU 96 provides an alarm output enable signal on a line 118 to the input of an OR gate 120, the other input connected to the XMIT signal indicating a transmit operation.

Figure 7A:
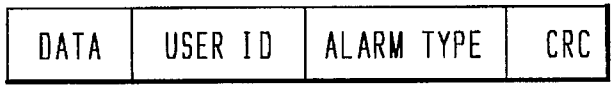
FIG. 7*a* illustrates a diagram of the data field.

The output of OR gate 120 is input to a PN code generator 122 on a start input. The PN code generator 122 is clocked by the clock signal on line 109 to provide on the output thereof a PN code signal for input to the other input of the exclusive OR gate 114. Therefore, when the alarm signal is indicated, data is extracted from the EEPROM 100 and placed on the input to the flip-flop 106. This data is illustrated in FIG. 7*a*, which illustrates the manner in which the data is transmitted. The data is comprised of four fields, a data field, a user ID field, an alarm type field and a CRC field. The data field provides the forty bits of data which is followed by a unique user ID associated with the locator 10. Thereafter, an alarm field determines the alarm type, i.e., whether it is a real alarm, a test, a fire, etc. In the preferred embodiment, only one alarm type is provided for. However, multiple input switches could provided for indicating different types of alarms. The last field is a CRC field which provided cyclic redundancy check bits for the purpose of error. The data field illustrated in FIG. 7*a* is output in a serial manner such that the data field is continually output, it being sequential fields or periodic fields. This data is ORed with the exclusive OR 114 with the PN code to provide an output PND.

Figure 8:
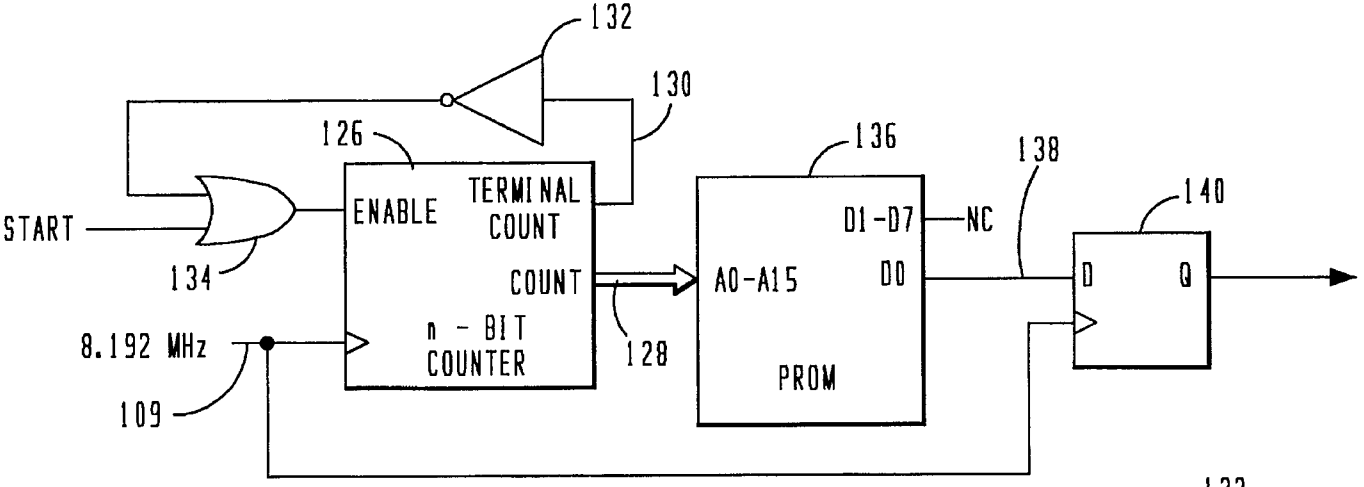
FIG. 8 illustrates a block diagram of the code generator for the locator.

Referring now to FIG. 8, there is illustrated a block diagram of the PN code generator 122. The PN code generator is essentially a counter 126 which provides for N-bits on a count output bus 128. When the counter 126 rolls over, it outputs a terminal count on a line 130, which is inverted by an inverter 132 and input to one input of an OR gate 134, the other input thereof input to an START signal. The output of the OR gate 134 is input to an ENABLE input on the counter 126. The counter 126 is docked by an 8.192 MHz signal on the line 109. The count output bus 128 is input to the address input of a Programmable Read Only Memory (PROM) 136 that has stored therein bits of information in the form of words. Each word is eight bits wide with data bits D0–D7. However, in the preferred embodiment, only the DO bit is output on a line 138 to the input of a D-flip-flop 140. Flip-flop 140 is docked by the signal on line 109 with the Q-output thereof providing the PN code.

Figure 9A:
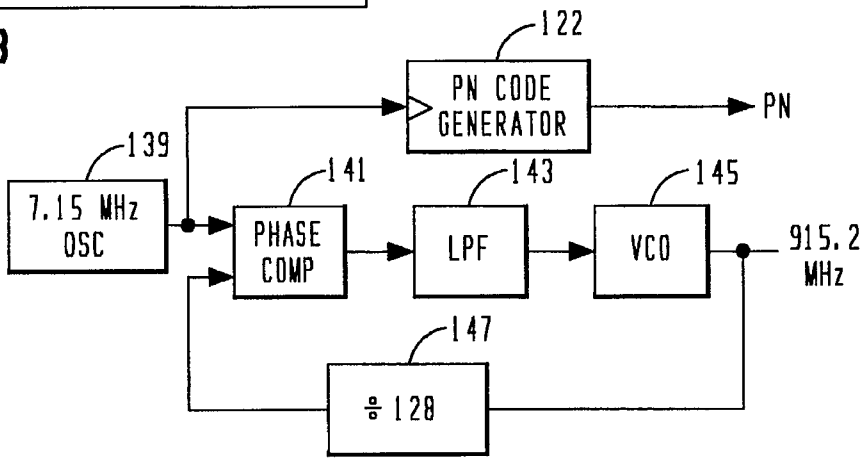
FIG. 9*a* illustrates an alternate body utilizing a phase lock loop for generation of the clock to the PN code generator.
Figure 9:
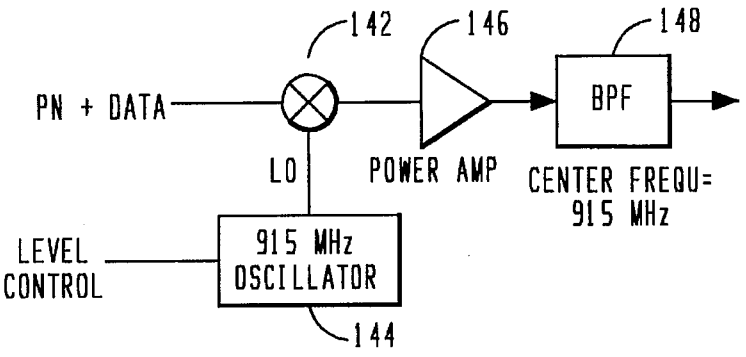
FIG. 9 illustrates a block diagram of the RF section of the locator.

Referring now to FIG. 9, there is illustrated a block diagram of the RF section 80. The output of the exclusive OR gate 114 is input to the input of a mixer 142 which has the local oscillator (LO) input thereof connected to a 915 MHz oscillator 144. This provides an up converter operation which mixes the base band data up to 915 MHz. This is input to a power amplifier 146, the output thereof passed through a bandpass filter 148 to provide the output signal. Additionally, there is a level control input on the 915 MHz oscillator 144 which is controlled by the digital section 78 to select the power level.

Referring now to FIG. 9*a*, there is illustrated an alternate embodiment illustrating a system for synchronizing the PN code to the carrier. The purpose for doing that is, if the receiver locks onto the carrier, this inherently locks onto the PN code and thereby increases the sensitivity. In this embodiment, the oscillator signal that drives the PN code generator 122 is a 7.15 MHz oscillator 139 which has the output thereof input into a phase comparator 141 and also to the clock input of the PN code generator 122. The phase comparator 141 has the output thereof input to a low pass filter 143, comprising the loop filter of a phase lock loop. The low pass filter comprises the driving signal for a voltage controlled oscillator (VCO) 145, the output of which provides the carrier frequency of 915.2 MHz. The output of the VCO 145 is also connected to the input of a divider block 147, which provides a division operation by a factor of 128. The output of the divider block 147 is input to the other input of the phase comparator 141. Comparator 141, low pass filter 143, VCO 145 and divider block 147 form a conventional phase lock loop. In this manner, the carrier is phase locked to the PN code generator 122.

Figure 10:
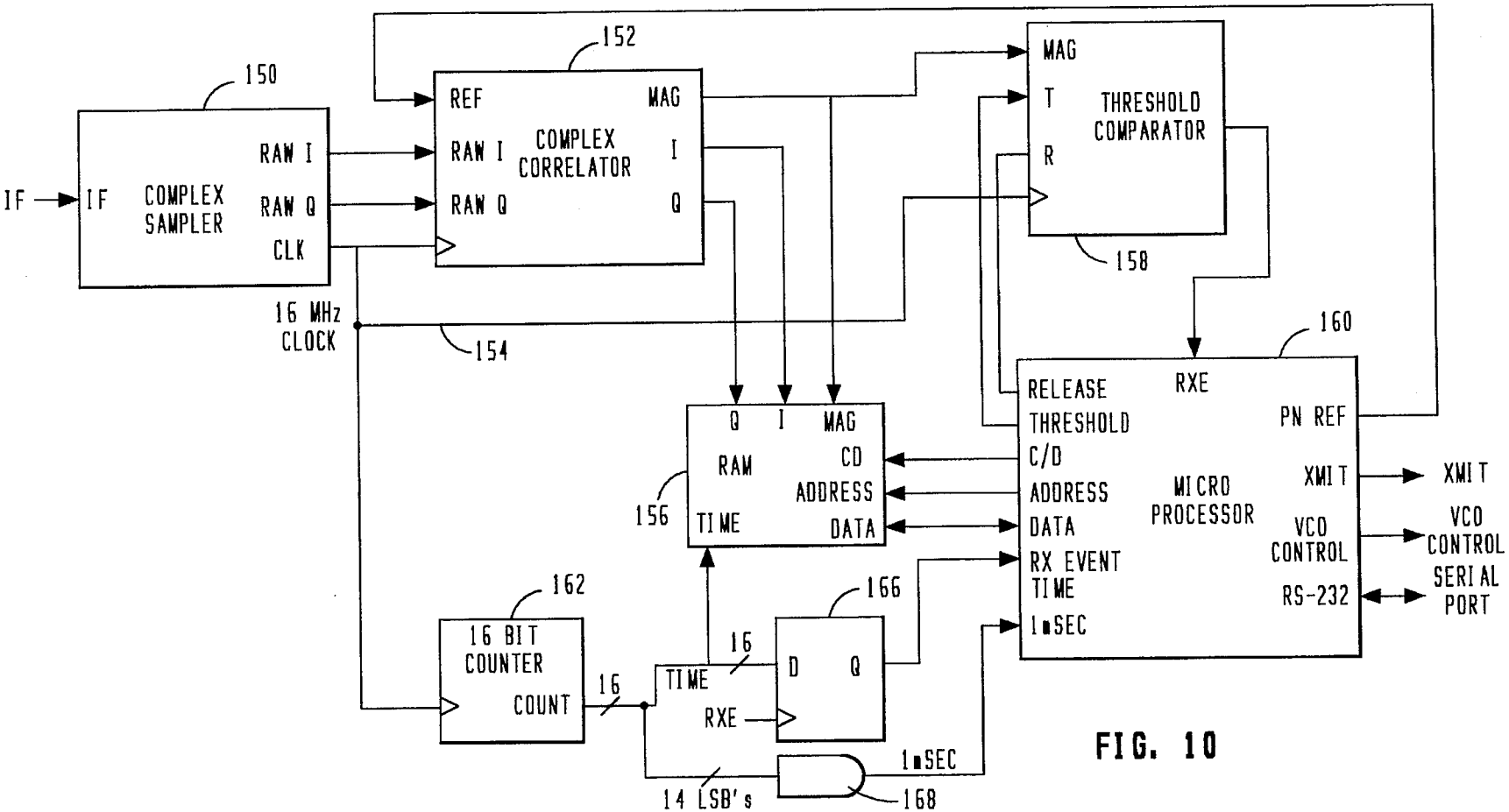
FIG. 10 illustrates a block diagram of the digital section of the receiver.

Referring now to FIG. 10, there is illustrated an overall block diagram of the digital section of the receiver 14. In general, the receiver 14 is comprised of a digital section and an RF section, the RF section receiving on the input a 915 MHz signal from the antenna 18. The RF section (not shown) is operable to output an IF signal containing the data which is input to a complex sampler 150. The complex sampler 150 is operable to take the IF signal which has a nominal 16 MHz frequency, and digitize it at precisely four times the carrier frequency. When sampling at this rate, it is easy to show, that out of the group of four samples, the first and third represent the in phase "1-Phase" samples, while the second and fourth samples represent the quadrature phase "Q-Phase" samples. The third sample is taken 180° out of phase with respect to the first sample and thus would be called a -I ("Negative I") sample. Accordingly, when combining the first and third samples, the third sample must be multiplied by −1 before combining it with the first sample; that is, adding it to the first sample. Similarly, the fourth sample must be multiplied by −1 before combining it with the second sample.

The output of the complex sampler 150 is input to a complex correlator 152, which is operable to match the digitized sample against a reference PN code supplied by the microprocessor and then seeks to determine a match. Two samples per chip are supplied by the complex correlator 152. For each 16 MHz clock signal that is output by the complex sampler 150 on a clock line 154, an I, Q and magnitude sample are output. The magnitude samples are fed to a threshold comparator 158, while all three values are sent to a Random Access Memory (RAM) 156 for storage therein. In the preferred embodiment, the correlator should be at least $2^{13}-1$ (8195) chips (16,390 samples). This represents at 8 Mcps about a 32 μ sec duration of time. This particular building block configuration of the complex correlator 152 is a conventional technique.

The complex correlator has the magnitude output thereof input to the threshold comparator 158. The threshold comparator 158 is operable to compare the magnitude sample with a reference value ("threshold") supplied by a microprocessor 160. The output of the threshold comparator 158 is input to the RXE input of the microprocessor 160. Both the threshold voltage and a release signal output from the microprocessor 160 for input to the threshold comparator 158. The microprocessor 160 is also operable to generate the various address and data signals for input to the RAM 156. The clock signal on line 154 is input to the clock input of a 16-bit counter 162 that is a free-running counter with no pre-set, lows or clear functions required. This, is the arbiter of time for each receiver. A 16 MHz clock tick causes the counter to increment by one count. Because the counter is a 16-bit counter, it will overflow once every $65536/16.384\times 10+10^6=4$ milliseconds. Whenever a receive event occurs, the rising edge input to the RXE input will latch the value on the counter such that the microprocessor 160 may read at what time the event occurred.

The 13 Least Significant Bits (LSBs) of the counter 162 are used to generate a pulse once every millisecond. The counter 162 also serves as an address generator during the collection of I, Q and magnitude data from the complex correlator 152. Each sample is stored in a location, the address of which is the time at which it was taken. This is useful because a more accurate time of arrival measurement can be obtained if the system tags random samples taken in the neighborhood of the sample which trigger the receipt of that indicator. A D-type flip-flop 166 is provided, having a D-input thereof connected to the output of the counter 162. The clock input is clocked by the RXE signal output by the threshold comparator 158. The RXE signal is the "RECEIVE EVENT" signal that captures the time at which the receive event occurs. The Q-output of the flip-flop 166 is input to the RX EVENT input of the microprocessor 160. Additionally, the output of counter 162 is buffered by a 14-bit AND gate 168 that provides an output when all 14 bits are logic "1s", which will happen once every millisecond. This signal is provided to an interrupt input on a microprocessor 160, this interrupt incrementing a counter internal to the microprocessor 160 for the purpose of keeping track of time.

Figure 11:
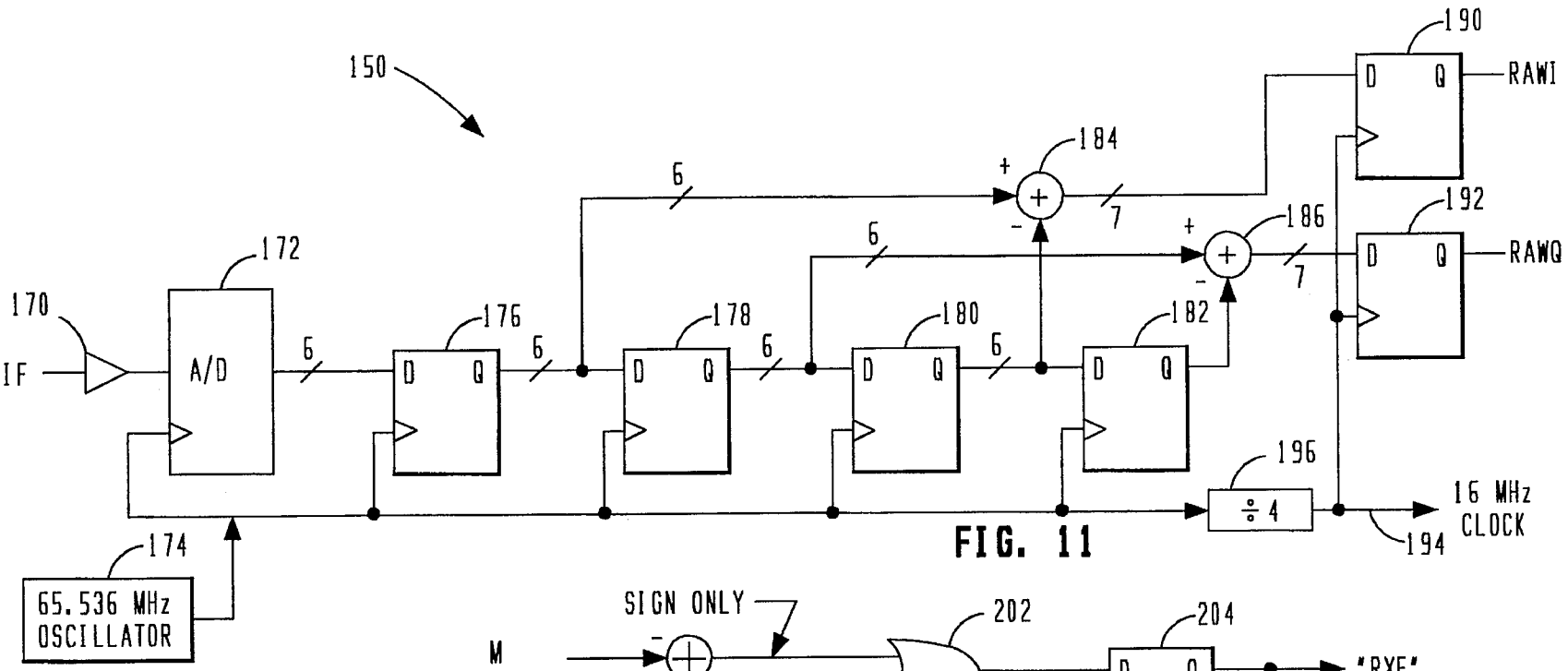
FIG. 11 illustrates a block diagram of the complex sampler of the receiver.

Referring now to FIG. 11, there is illustrated a block diagram of the complex sampler 150. The IF input is buffered by a buffer 170 and input to the analog input of an A/D converter 172, the input thereof clocked by sampling clock 174 operating at a frequency of 65.536 MHz. This is a flash 6-bit A/D converter. The output of the A/D converter 172 is fed to a 6-bit wide four stage shift register comprised of four flip-flops 176, 178, 180 and 182, the Q-output of flip-flop 176 connected to the D-input of flip-flop 178, the Q-output of flip-flop 178 connected to the D-input of flip-flop 180 and the Q-output of flip-flop 180 connected to the D-input of flip-flop 182. The output of flip-flop 176 is connected to the positive input of a summing junction 184 and the Q-output of flip-flop 180 is connected to a negative input thereof to provide a subtraction operation. Similarly, the Q-output of flip-flop 178 is connected to a positive input of a summing junction 186, the negative input thereof connected to the Q-output of summing junction 182. The output of flip-flop 184 is connected to the D-input of a flip-flop 190, and the output of summing junction 186 is connected to the D-input of a flip-flop 192. Both flip-flops 190 and 192 clocked by 16 MHz clock signal on a line 194 that is generated by dividing the output of oscillator 174 by a factor of 4, with a divide block 196. The summing junction 184 is operable to provide the combination of the first and third samples while the summing junction 186 is operable to combine the second and fourth samples. The flip-flop 190 provides the "I" output and the flip-flop 192 provides the "P" output. It is important to note that the clock signal line 194 is exactly twice the clock rate of the PN chipping rate.

Figure 12:
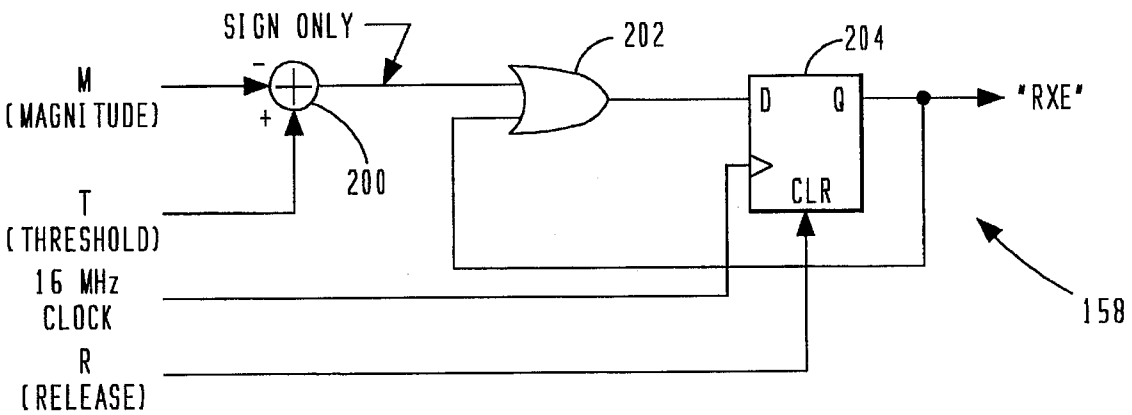
FIG. 12 illustrates a block diagram of the threshold comparator of the receiver.

Referring now to FIG. 12, there is illustrated a block diagram of the threshold comparator 158. The magnitude signal is input to a negative input of a summing junction 200, the positive input thereof connected to the threshold voltage from the microprocessor 160. The output of summing junction 200 provides the sign only and is input to one input of an OR gate 202. The output of OR gate 202 is input to the D-input of a flip-flop 204, the Q-output thereof providing an RXE output signal. The output of flip-flop 204 is set back to the other input of the OR gate 202. Flip-flop 206 is clocked by the clock signal line 194 with the clear input thereof connected to a release signal RELEASE from the microprocessor 160.

In operation, the summing junction 200 computes a difference between the magnitude and threshold which, assuming two's complement math, as long as the magnitude is less than the threshold, and this value is positive, the sign at the result is a logic "0". Just after the previous receive event, the microprocessor 160 will "release" (clear) the value on the output of flip-flop 204 such that the value Q=0. Assuming that this is still the case, then the OR gate 202 just prior to the flip-flop input having a "0" on a lower input and its output therefore tracks the sign of the output just computed. Assuming that the sign is "0", Q remains at a logic "0", indicating that no receive event has occurred. When the N value equals the threshold, the difference T-M goes negative and the sign becomes a logic "1". Assuming for the moment that the value Q on the output of flip-flop 204 is still a "0", then the OR gate 202 still tracks the sign and the value presented to the flip-flop becomes a logic "1". After the next clock tick, Q becomes a logic "1", indicating that a receive event has occurred. This value is sent back to the OR gate 202. Because a logic "1" is ORed with X=1 for any X, the flip-flop 204 is effectively locked into a logic "1" position. This remains so until the microprocessor clears the flip-flop 204 by way of the RELEASE. The intent is to use the rising edge just observed as an interrupt to the microprocessor. It will also be used to activate a locator transmit pulse. Note that both of these require a pulse longer than that found during a single 16 MHZ clock tick.

Figure 13:
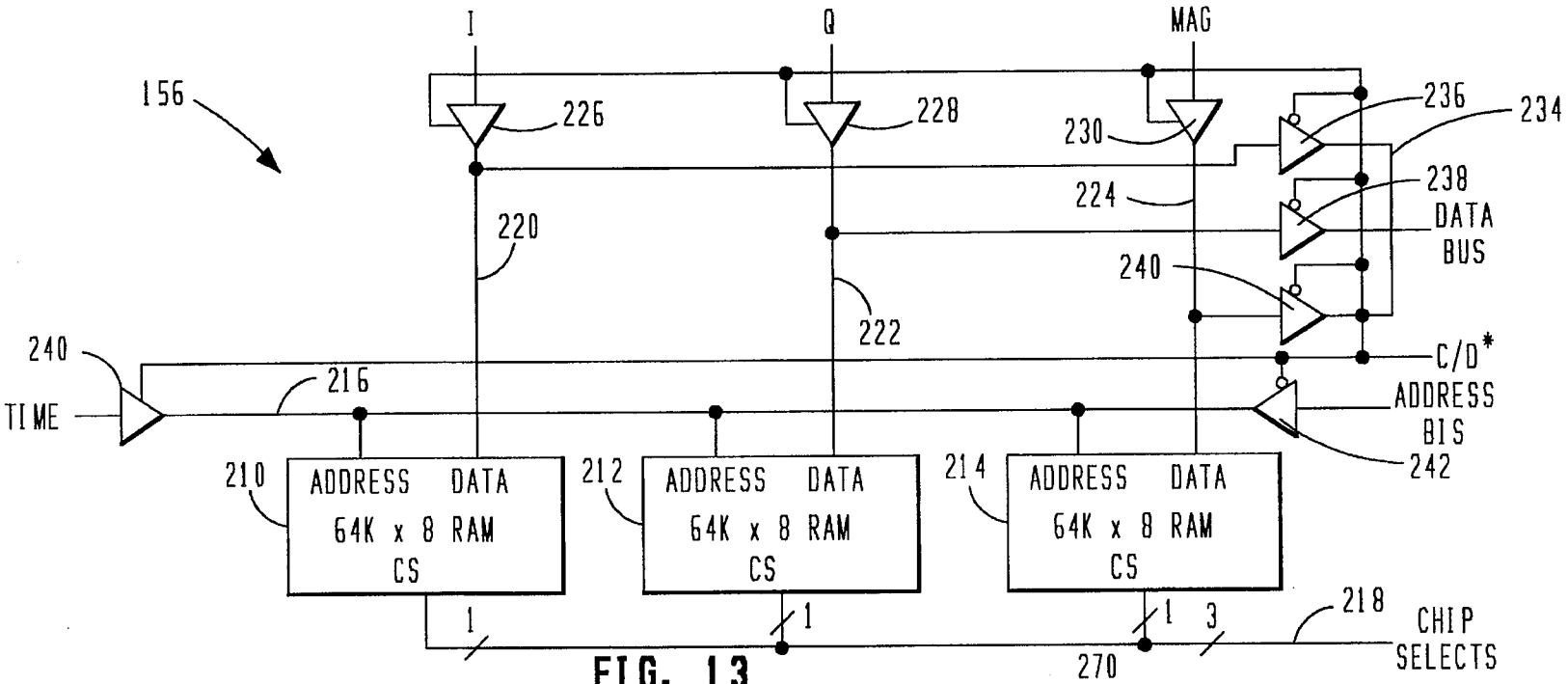
FIG. 13 illustrates a block diagram of the RAM storage portion of the receiver.

Referring now to FIG. 13, there is illustrated a block diagram of the RAM 156. The RAM 156 is comprised of three individual memory chips, the address therein connected to an address bus 216 and the chip select inputs connected to three chip select lines 218. The data lines in each of the RAMs 210–214 are provided by data lines 220, 222 and 224, respectively. The I-input is connected to a data line 220 via a gate 226, the Q-input is connected to the data line 222 via a gate 228 and a MAG input is input to data line 224 via a gate 230. Gates 226–230 are gated by a C/D* signal. For a Read operation, data line 222 is connected to the data bus 234 via a gate 238 and data line 224 is connected to the data bus 234 via a gate 240. Each of the data lines 220–224 is a single bit data line with each of the RAMs 210–214 being a single data bit wide. The data bus 234 is a 3-bit data bus for receiving the data bits from the data lines 220–224, respectively. The gates 236–240 are clocked by the inverse of the signal C/D*. The C/D* signal is referred to as the "collect/not dump" line. Whenever the C/D* line is true, the I/Q and magnitude samples will be stored and, when the C/D* line is high, the timer counter serves as an address generator via a gate 240. Each sample is therefore uniquely addressed at a time at which it was taken. Accordingly, a gate 242 that operates inverse to the gate 240 allows the address bus of the processor 160 to control the RAMs 210–214. Whenever the microprocessor 160 wants to examine the memory 210–214, the C/D line is taken "low".

Figure 14:
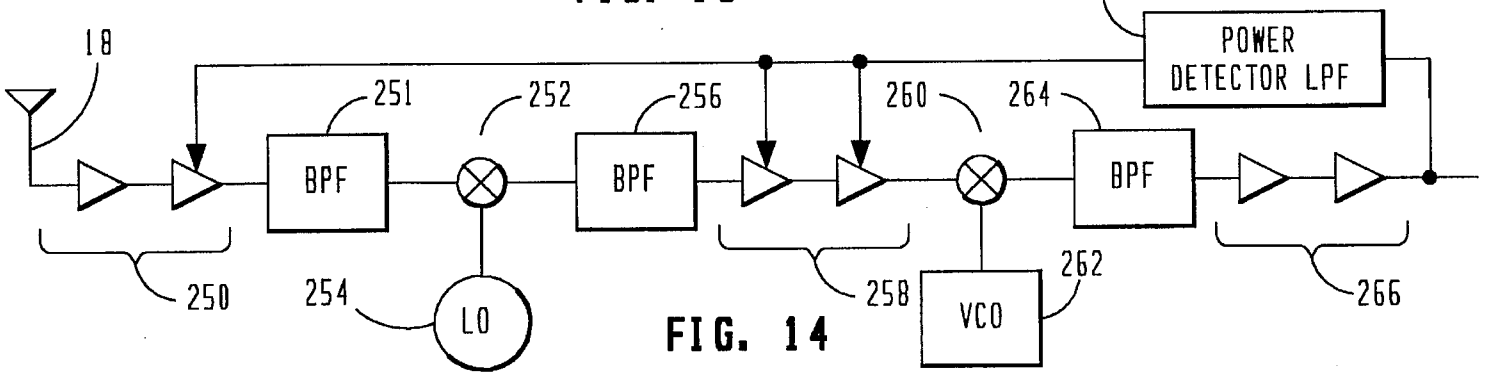
FIG. 14 illustrates a block diagram of the RF section of the receiver.

Referring now to FIG. 14, there is illustrated a block diagram of the RF section of the receiver 14. The 915 MH signal received by the antenna 18 is input to a low noise amplifier section 250, the output thereof input to a bandpass filter 251, the output thereof input to a mixer 252. A local oscillator 254 has the output thereof input to the local oscillator input of the mixer 252, the mixer 252 then operating as a down converter to downconvert the 915 MHZ signal to a frequency of 150 MHZ. This is input to a bandpass filter 256 to filter out the first IF. This is input through an amplifier 258 to a second mixer 260. The second mixer has a local oscillator input connected to the output of a VCO 262 to downconvert the first IF signal to a frequency of 16 MHZ. If the output of the mixer 260 is input to a bandpass filter 264, the output thereof comprising a 16 MHZ IF signal. This is later downconverted in the final step to base band data by the A/D converter 172 and the complex sampler 150.

The bandpass filters 251,256 and 264 are provided for two reasons. First, the bandpass filter 251 is provided to reject out-of-band interference and avoid overload of the succeeding low noise amplifier and other amplifiers. Secondly, the bandpass filters are supplied to provide image rejection. The local oscillator 254 is a sixth frequency local 254 oscillator at 765 MHZ with the VCO 262 operating in a nominal frequency of 134 MHZ. This, however, allows fine tuning over a range of +/±0.5 MHZ.

An Automatic Gain Control (AGC) function is provided by a power detector 270, which has the input thereof connected to the output and controls the various amplifiers in the chain.

The overall operation of this system is achieved by the user, when in a perilous situation by pressing the switch 88 to sound an alarm. As described above, this is sealed switch that, when the seal is broken, forces the alarm signal to be continuously output. This alarm signal is transmitted via the RF link to the receivers 14. This is done in a high power mode. This high power mode occurs on a periodic basis for a predetermined duration of time, at least 60 seconds. During this time period, the receivers 14 and the monitor 22 are operable to receive and decode the PN code sequences. Due to the PN code sequence, multiple signals can be received at substantially the same time and discriminated. Although there is a probability that two transmitters would transmit at the same time and be received at the same time and have exactly the same time of arrival at each receiver, i.e., they are co-located, this is a very low probability. As such, the use of a larger number of receivers over a given location would allow discrimination. Each time one of these code sequences containing information and ID information is received, the data indicating the alarm type is noted, the ID is noted and the time of arrival is noted for a given receiver. This is then forwarded back to the monitor 22 to determine what action is to be taken. Once an alarm is created at the monitor station, the security personnel then utilize the portable monitor 62 to go to the general vicinity of the determined location. At this location, they utilize the portable monitor 62 for the purpose of doing a "find" location of the particular locator and the individual that set the alarm off. This allows the location to be determined within twenty to thirty feet. During this period of time, the locator has entered a low power mode such that the security official must be relatively close to the monitor. This is done for the purpose of conserving energy.

In the preferred embodiment, the system of the present invention will be incorporated on a smart card with the use of various integrated circuits that are conventionally available. Therefore, only a certain size battery can be accommodated, thus minimizing the time that the alarm can be generated. In general, the card is activated once, the battery drained and then the card essentially disposed of and a new card issued. Therefore, the battery must be sized correctly and the power conserved in order to transmit a high integrity signal that can be received, located and actions taken.

Figure 15:
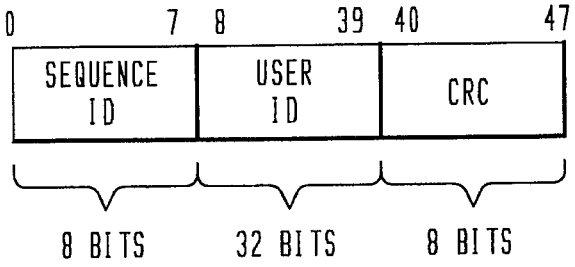
FIG. 15 illustrates a diagrammatic view of the data block that is transmitted.

Referring now to FIG. 15, there is illustrated a diagrammatic view of a data block. The data block is comprised of three fields, a Sequence ID field, a User ID field and a CRC field. The Sequence ID is an eight bit field that is incremented by one count every time the system broadcasts the User ID/CRC fields. This field is included such that each receiver can uniquely describe the exact instance in time at which a particular data bit was received. The Sequence ID field begins at "0" counts up to "255" and then rolls over to "0". This Sequence ID is repeated forever. The number of blocks of data transmitted per second is a function of the bits-per-second rate of transmission divided by the number of bits in the data block, in this case 48 bits. In the preferred embodiment, data blocks are transmitted at 1000 bps, resulting in 21 data blocks being transmitted per second.

The User ID is a 32 bit field which allows assignment of better than 4 billion unique IDs per a location, such as a college campus. The system administrator may wish to subdivide this field; in particular, the system administrator may wish to designate certain bits to have special meanings. For example, he could designate the first or the last two bits as an "alarm" type. The alarm type field would then be interpreted as a number between 0–3 with the number "0" being a built in test value which would be ignored. This would only be used by test technicians. An alarm type of "1" would be a time coordination message, which would be an alarm type that is utilized by the monitor segment to broadcast time coordination messages. An alarm type of "2" would be a subscriber alarm. This is the alarm type used by every victims locator.

The CRC field is an eight bit field that is used to verify the integrity of the transmission. The frame sync is obtained by exhaustively examining all possible positions for the CRC field and finding the position at which the CRC properly checks. By examining all bits in both a positive-true and negative-true fashion, this would resolve any bit encoding ambiguity.

There are two ways in which to provide some confidentiality to the system. The first is to scramble the User ID bits, the second is to encrypt the User ID bits. In the preferred embodiment only the User ID bits are encrypted or scrambled, but it should be understood that the entire data block could be encrypted in some manner.

In the preferred embodiment, the Sequence ID field is always broadcast with no encryption or scrambling. The User ID is sent in a fashion that is either scrambled or encrypted or both. This allows the user to recognize the data block without a block decryption device or a block unscrambler.

Figure 16:
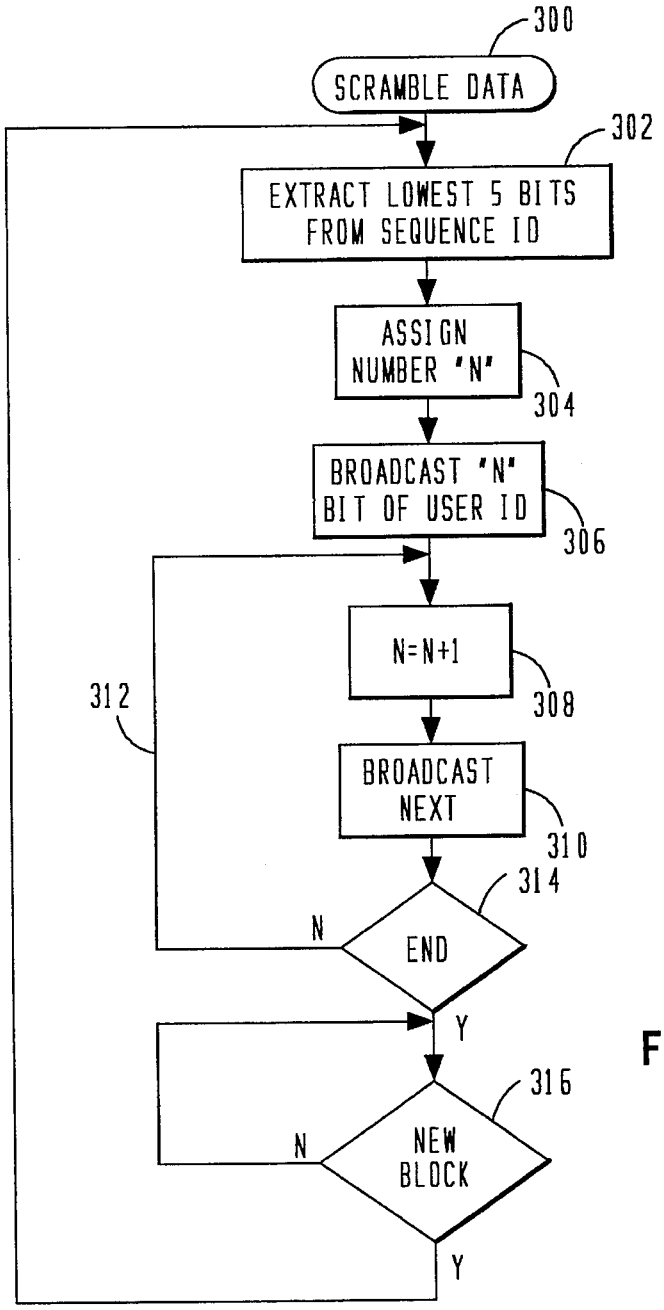
FIG. 16 illustrates a flow chart for the operation to scramble the data bits in the data block.

Referring now to FIG. 16, there is illustrated a flow chart of the data scrambling operation. This is initiated at a block 300 and then proceeds to a function block 302 wherein the lowest five bits from the Sequence ID are extracted. This essentially takes the Sequence ID to a modulo 32 base. The program then flows to a function block 304 which then interprets this as a number from 0 to 31 and assigns this a number "n". The program then flows to a function block 306 to broadcast the nth bit first and then flows to a function block 308 to increase the number "n" by the value of one and then broadcasts the next bit, as indicated by function block 310. The program loops back along a path 312 until all 32 bits in the User ID are broadcast. Once all 32 bits are broadcast, the program flows from a decision block 314 to a decision block 316 to determine if a new data block has been generated. If so, the program flows along a "Y" path back to the input of the function block 302. Until the new block has been received, the program will flow along a "N" path back to the input of the decision block 316.

Figure 17:
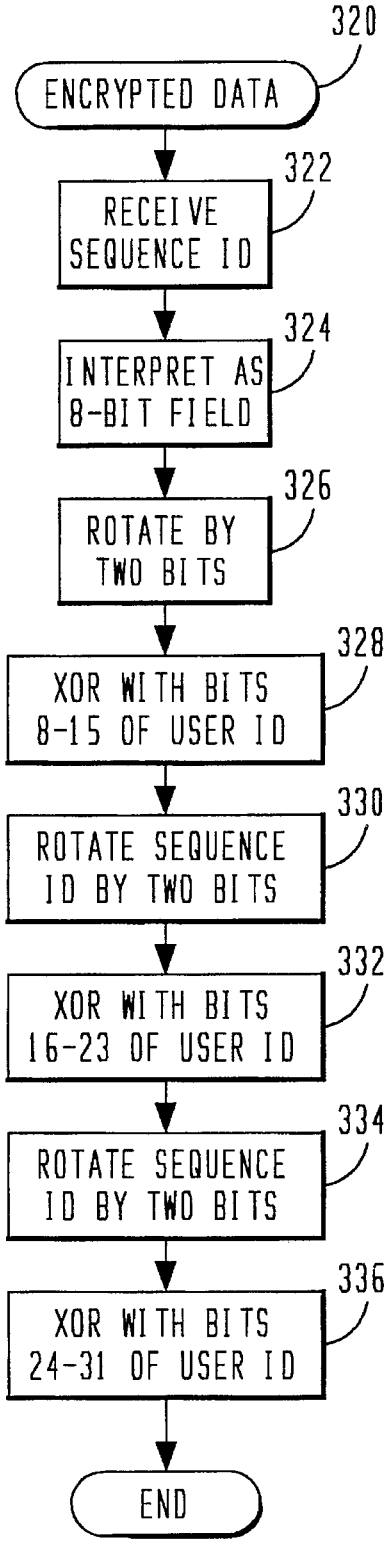
FIG. 17 illustrates a flow chart for encrypting the data in the data block.

Referring now to FIG. 17, there is illustrated a flow chart for the encryption operation, which is initiated at a block 320 and then flows to a function block 322. In function block 322, the Sequence ID is received and then the program flows to a function block 324 to interpret the Sequence ID as an 8 bit field. The 8 bit field is then rotated by 2 bits, as indicated by a function block 326, and then this value XORed with bits 8–15 of the User ID as indicated by the function block 328 to provide the first eight encrypted bits for the data field. Thereafter, the Sequence ID is rotated by 2 bits, as indicated by function block 330, and then XORed with bits 16–23 of the User ID, as indicated by a function block 332. The program then flows to a function block 334 to rotate the Sequence ID by 2 bits and then to function block 336 to XORed this value with bits 24–31 of the User ID. To decrypt this data, it is only necessary to perform the reverse operation.

Although the preferred embodiment has been described in detail, it should be understood that various changes, substitutions and alterations can be made therein without departing from the spirit and scope of the invention as defined by the appended claims.

What is claimed is:

1. A personal security system for locating a person within a predetermined locale, comprising:

a plurality of receivers disposed about the predetermined locale for receiving an alarm transmission;

one or more portable transmitters for being carried on a person, each said portable transmitter having:

an alarm switch for being activated by the person, a battery for supplying power, a processor for generating an alarm signal and encoding said alarm signal onto a carrier as an encoded alarm signal, and a transmitter for transmitting said encoded alarm signal as said alarm transmission at first and second power levels, at said first power level, said alarm transmission reaching the closest ones of said plurality of receivers and, at said second power level, to an area proximate to said portable transmitter, said transmitter powered by said battery;

a control system for controlling said transmitter to operate at said first power level for a predetermined duration of time and, thereafter, at said second power level until the power in said battery is drained;

a central control system for interfacing with each of said receivers and receiving the information received thereby, each of said plurality of receivers operable to determine the time that said alarm transmission is received by said receiver, said central control system operable to determine a location of said locator by a time-of-arrival method; and a portable monitoring system having associated therewith a directional receiver for receiving said alarm transmission when said control system for said portable transceiver forces said transmitter to operate at said second power level, said portable monitoring system operable to determine a relative position when said portable monitoring system is in the RF field of each said transmitter at said second power level to more specifically locate each said portable transmitter.

2. The personal security system of claim 1, wherein said alarm switch is operable to be depressed once and then locked into position to maintain said transmitter operating at said first or second power level until said battery is drained.

3. The personal security system of claim 1, wherein said alarm signal comprises pseudonoise code ORed with data.

4. The personal security system of claim 3, wherein said data that is ORed with said pseudonoise code is comprised in part of a unique identification code for said portable transceiver and wherein said central system is operable to distinguish said received alarm transmission by each of said receivers as associated with one of a plurality of unique IDs in a lookup table.

5. The personal security system of claim 3, wherein said processor comprises a pseudonoise code generator for generating said pseudonoise code.

6. The personal security system of claim 5, wherein said pseudonoise code generator is operated with an external oscillator and further comprising a phase lock loop device for phase locking said pseudonoise code generator to said carrier.

7. The personal security system of claim 1, wherein said portable transmitter further includes a receiver for receiving an RF carrier modulated with data from said central control system and said central control system includes a transmitter for transmitting user input data to said receiver associated with said portable transmitter.

8. The personal security system of claim 1, wherein each of said portable transmitters is associated with a user encoded alarm signal that comprises timing information and User ID information regarding the user associated with a select one of said portable transmitters.

9. The personal security system of claim 8, wherein the data of said user encoded alarm signal is transmitted in blocks of data with each of said blocks being disposed in a periodic and sequential format with said timing information associated with each of said blocks being incremental such that said timing information can be decoded by said receivers when received thereby, each of said receivers having a decoder associated therewith.

10. The personal security system of claim 9, wherein each of said blocks of data is comprised of fields with at least one field associated with said timing information and at least one field associated with said User ID in a predetermined data format and further comprising a security encoding system at said portable transmitter for encoding one of said timing information or said User ID in accordance with a predetermined encryption algorithm to provide an encrypted portion in said data block, and a corresponding security system at each of said receivers for decrypting said encrypted portion in said data block.

11. The personal security system of claim 10, wherein only said User ID is encrypted.

12. The personal security system of claim 10, wherein said encrypted portion is encrypted with an encryption algorithm that is operable to rotate said timing information which is in the form of an n-bit data word by m-bits then XOR the result of the rotated timing information with the first "n" bits of said User ID, said User ID being a data field of a length z x n, where z is an integer, then rotating said timing information again by m-bits and XOR the results with the next "n" bits of said User ID, and repeating this process for all bits of said User ID, said receivers being operable to reverse the process for decrypting said data.

13. The personal security system of claim 10, wherein said encrypted portion of said data is encrypted by extracting the lower 5 bits of said timing information, said timing information being an n-bit word, and interpreting this number as a number from 0 to 31 and assigning this a value "m" thereto, thereafter broadcasting the mth bit first, followed by the (m+1)th bit next and so one until all bits in said User ID have been transmitted, said User ID being a multi-bit word, said receivers being operable to reverse the process for decrypting the data.

* * * * *

UNITED STATES PATENT AND TRADEMARK OFFICE

CERTIFICATE OF CORRECTION

PATENT NO. : 5,596,313

DATED : January 21, 1997

INVENTOR(S) : Berglund et al.

It is certified that error appears in the above-indentified patent and that said Letters Patent is hereby corrected as shown below:

Column 1, line 58, delete "carded", and insert therefor -carried--;

Column 6, line 6, delete "pattern", and insert therefor -patterns--;

Column 6, line 65, delete "DO", and insert therefor --0--;

Column 10, line 8, delete "MH", and insert therefor --HZ--;

In the Claims:

Claim 9, column 14, line 4, after the word "format", nsert --,--;

Claim 12, column 14, line 24, after the word "m-bits", nsert --,--.

Signed and Sealed this

Fourteenth Day of October, 1997

*Attest:*

Bruce Lehman

BRUCE LEHMAN

*Attesting Officer*

*Commissioner of Patents and Trademarks*